US005639352A

United States Patent [19]

Ruf et al.

[11] Patent Number: 5,639,352

[45] Date of Patent: Jun. 17, 1997

[54] HEADBOX LAMELLAE AND METHOD FOR REDUCING TURBULENCE THEREABOUT

[75] Inventors: Wolfgang Ruf, Heidenheim; Helmut Heinzmann, Böhmenkirch; Ulrich Begemann, Leonberg, all of Germany

[73] Assignee: J.M. Voith GmbH, Heidenheim, Germany

[21] Appl. No.: 297,315

[22] Filed: Aug. 29, 1994

[30] Foreign Application Priority Data

Sep. 3, 1993 [DE] Germany ..... 43 29 810.9

[51] Int. Cl.[6] ..... D21F 1/06; D21F 1/02

[52] U.S. Cl. ..... 162/216; 162/336; 162/343

[58] Field of Search ..... 162/216, 336, 162/343

[56] References Cited

U.S. PATENT DOCUMENTS

| | | | |
|---|---|---|---|
| Re. 28,269 | 12/1974 | Hill et al. | 162/343 |
| 3,607,625 | 9/1971 | Hill et al. | 162/343 |
| 3,843,470 | 10/1974 | Betley et al. | 162/343 |
| 4,125,429 | 11/1978 | Hergert et al. | 162/343 |
| 4,181,568 | 1/1980 | Pfaler | 162/343 |
| 4,349,414 | 9/1982 | Stenberg | 162/123 |
| 4,445,974 | 5/1984 | Stenberg | 162/300 |
| 4,566,945 | 1/1986 | Ewald et al. | 162/343 |
| 4,604,164 | 8/1986 | Fujiwara et al. | 162/343 |
| 4,812,208 | 3/1989 | Yuasa et al. | 162/343 |
| 4,941,950 | 7/1990 | Sanford | 162/343 |
| 5,013,406 | 5/1991 | Hergert | 162/343 |

FOREIGN PATENT DOCUMENTS

| | | |
|---|---|---|
| 1761229 | 4/1972 | Germany . |
| 2916351 | 11/1979 | Germany . |

*Primary Examiner*—Karen M. Hastings

*Attorney, Agent, or Firm*—Marshall, O'Toole, Gerstein, Murray & Borun

[57] ABSTRACT

A method and apparatus for reducing turbulence in a pulp flow stream flowing through a paper making machine headbox includes providing lamellae disposed in a portion of the headbox. A lamella end portion is modified which provides for the flushing of a dead space formed in the wake of the lamella. The modified lamella end portion produces small flow channels which divide the pulp stream flowing past the lamella into a plurality of substreams and guides the substreams into the region of the dead space.

22 Claims, 4 Drawing Sheets

Fig.5A
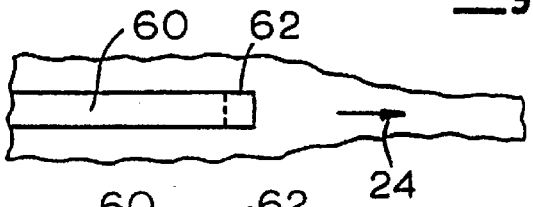
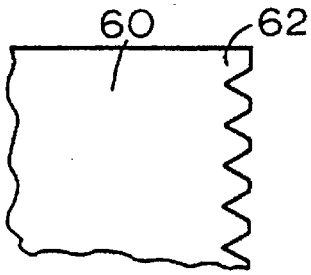
Fig.5B
Fig.6A
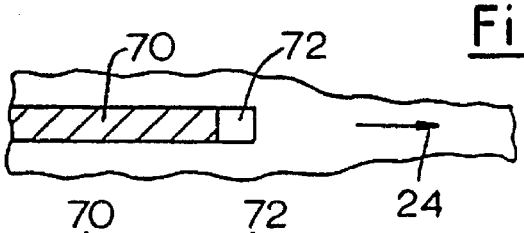
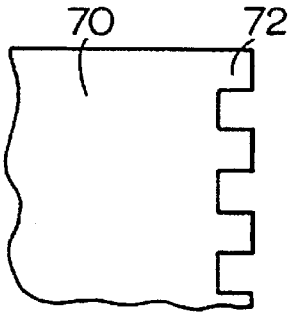
Fig.6B
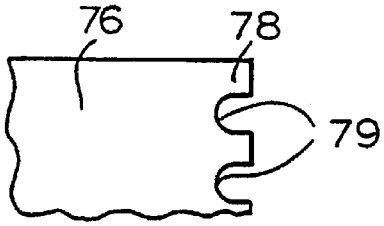
Fig.6C
Fig.7
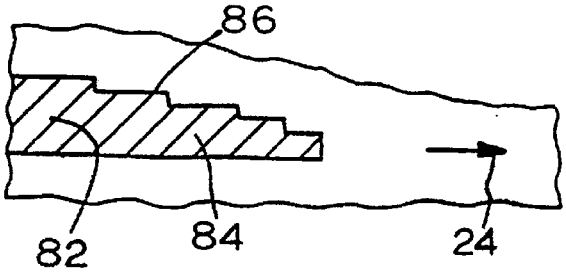

Fig.10A
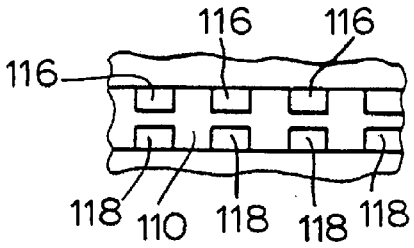
Fig.10B
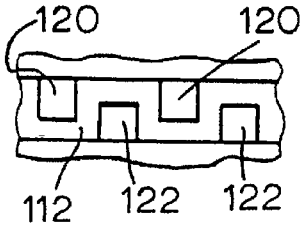
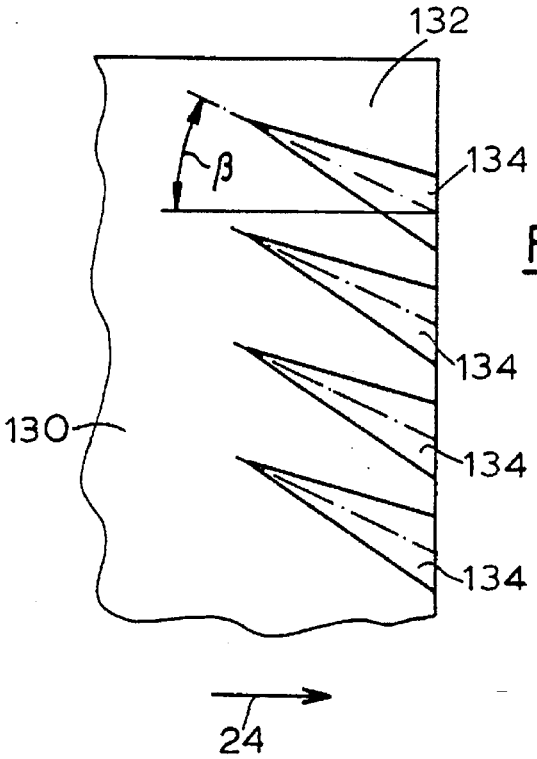
Fig.11
Fig.12
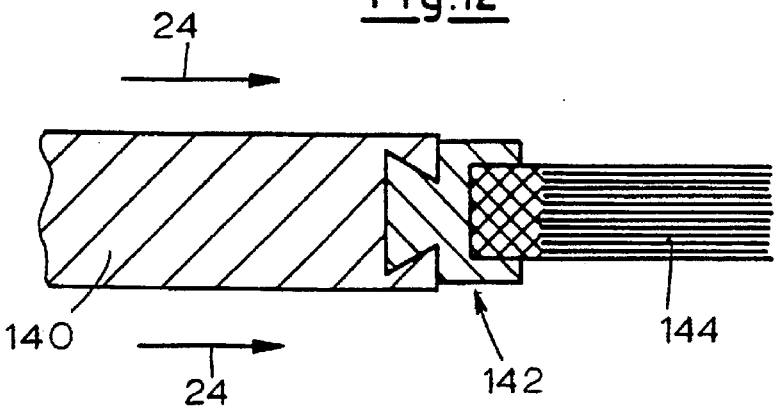

HEADBOX LAMELLAE AND METHOD FOR REDUCING TURBULENCE THEREABOUT

BACKGROUND OF THE INVENTION

1. Field of the Invention

The invention relates to paper machine head boxes having a plurality of channels at a downstream portion thereof defined by spaced lamellae, and in particular to the geometry of the lamellae.

2. Description of Related Technology

It is known to dispose lamellae (i.e., thin sheets or plates) in a multi-layer headbox at a downstream portion thereof with respect to the direction of flow of pulp through the headbox. The lamellae separate the pulp streams of a multi-layer headbox in such a way that mixing of the streams from the different layers does not occur until the streams are combined to a single stream near an exit opening of the headbox. The single stream of pulp then flows from the exit opening to a forming surface of a paper making machine.

The lamellae reduce turbulence in the flow channels defined thereby and provide pulp to the paper making machine forming surface in a form as undisturbed as possible. However, flow turbulence frequently originates at the downstream ends of the lamellae. Various attempts have been made to avoid such disturbances in the pulp flow. For example, German Patent Application DE 43 23 050 A1 discloses a lamella design that produces an increased flow convergence in the flow channel, resulting in an increase in flow velocity in this area, providing a reduction of disturbances due to turbulence.

Generally, turbulence at the end of a lamella can be reduced by tapering the end to a sharp edge. However, as a practical matter, a lamella cannot be made very sharp for reasons of manufacturing technology, cost and operational safety. As a consequence, because of the lamella end thickness, turbulence or periodic separated occurrences of turbulence occur which subsequently transfer vibration to the lamella end and thus to the entire lamella. As a result of this vibration, disturbances occur in the formation of the individual layers of pulp.

German Patent Application DE 29 16 351 (corresponding to Stenberg, U.S. Pat. Nos. 4,349,414 and 4,445,974) proposes to solve the lamella turbulence problems by providing lamellae with capillary ends which introduce air into the pulp stream and thus reduce turbulence. Such a headbox is apparently expensive to manufacture since the lamellae must be bored with a large number of small capillaries.

SUMMARY OF THE INVENTION

It is an object of the invention to overcome one or more of the problems described above. It is also an object of the invention to provide a method for reducing turbulence at a downstream end of a lamella and to provide lamellae for carrying out such a reduction.

According to the invention, a method and apparatus for reducing turbulence in a pulp flow stream flowing through a paper making machine headbox is provided. The headbox includes lamellae disposed in a portion thereof, each lamella having a downstream end with a dead space being formed directly downstream of the downstream end with respect to the direction of pulp flow through the headbox. The inventive method and apparatus includes providing means for flushing the dead space by forming small flow channels which divide the pulp stream flowing past a lamella into a plurality of substreams and guide the substreams into the region of the dead space.

Other objects and advantages of the invention will be apparent to those skilled in the art from the following detailed description taken in conjunction with the drawings and the appended claims.

BRIEF DESCRIPTION OF THE DRAWINGS

FIG. 5A is a partial side elevational view of a second embodiment of a headbox lamella according to the invention.

FIG. 5B is a partial top plan view of the headbox lamella of FIG. 5A.

FIG. 6A is a partial cross-sectional view of a third embodiment of a headbox lamella according to the invention.

FIG. 6B is a partial top plan view of the lamella of FIG. 6A.

FIG. 6C is a partial top plan view of a fourth embodiment of a headbox lamella according to the invention having a cross-section as shown in FIG. 6A.

FIG. 7 is a partial cross-sectional view of a fifth embodiment of a headbox lamella according to the invention.

FIG. 10A is a partial front elevational view of a tenth embodiment of a headbox lamella according to the invention.

FIG. 10B is a partial front elevational view of an eleventh embodiment of a headbox lamella according to the invention.

FIG. 11 is a partial top plan view of a twelfth embodiment of a headbox lamella according to the invention.

FIG. 12 is a partial cross-sectional view of a thirteenth embodiment of a headbox lamella according to the invention.

DETAILED DESCRIPTION OF THE INVENTION

According to the invention, the individual streams of a multi-layered headbox are combined at the end of a separating lamella without disturbing the flow within the channels defined by the lamella or the resulting combined pulp stream, thereby guarding against defects in sheet formation.

By methods and apparatus according to the invention, turbulence in the vicinity of the headbox lamellae ends is eliminated or reduced by flushing (i.e. providing fluid flow into) the space directly behind (i.e. downstream) each lamella end, referred to herein as the "dead space." The dead space is flushed by forming small flow channels at the lamella end thereby dividing the pulp stream into a plurality of substreams which are guided into the dead space.

The end of even a very thin lamella represents a final change of fluid velocities of various magnitudes, independent of lamella shape. This change may result in the periodic formation of turbulence which in turn leads to movements and vibrations of the lamella and thus to disturbances in fluid flow. According to the invention, fluid turbulence may be reduced by one or more of the following:

The lamella can be relaxed (i.e. made more flexible) by, for example, changing the modulus of elasticity of the material of the lamella and/or damping the lamella end portion (i.e. tip) with the goal of moving the natural resonance frequency of the entire lamella tip away from the excitation frequency arising from the fluid flow (mechanical detuning). Also, the frequency of the lamella tip should not be a multiple integer of the pulp excitation frequency.

Also, mechanical decoupling of individual regions of the lamella end, for example, by making slits in the downstream end portion of the lamella, results in altering the resonance frequency of the individual regions because such regions have a lower width in comparison to the total width of the lamella.

Furthermore, the hydraulically effective change in velocity levels at the lamella end can be changed in order to minimize or eliminate hydraulic excitation (the periodic triggering of small turbulence in the end region). This is accomplished by filling the dead space (i.e., the dead-water wedge in the wake of the lamella) with the pulp suspension. Hydraulic excitation may also be lessened by reducing the lamella thickness to less than 1 mm.

Figure 1:
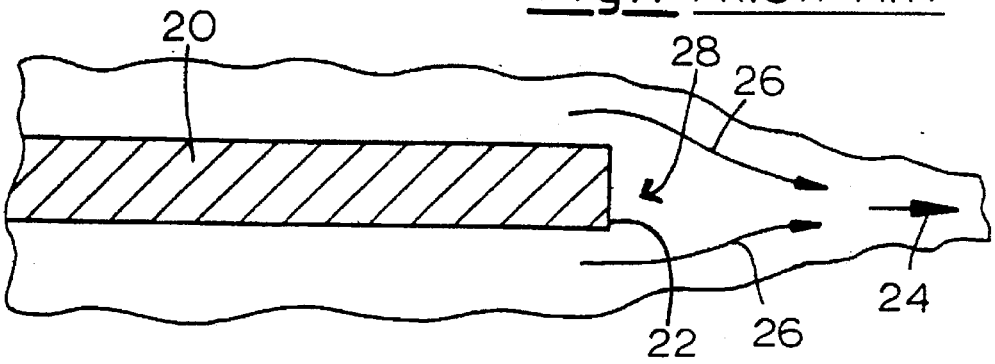
Fig.1 PRIOR ART
FIG. 1 is a partial cross-sectional view of a headbox lamella known in the art.
Figure 2:
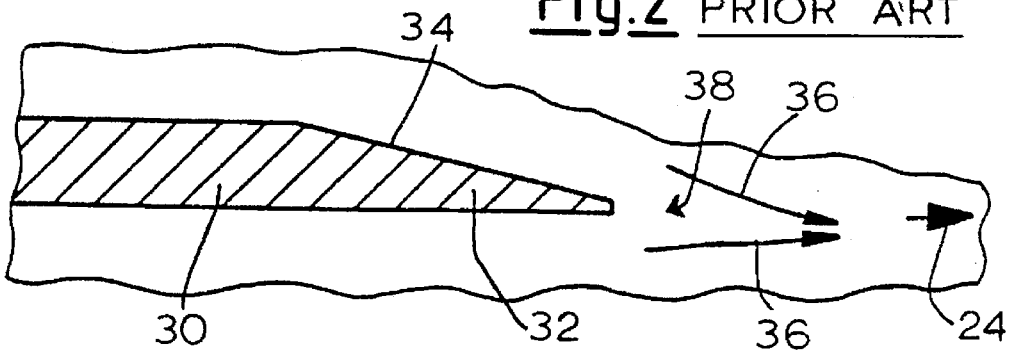
Fig.2 PRIOR ART
FIG. 2 is a partial cross-sectional view of a second embodiment of a headbox lamella known in the art.
Figure 3:
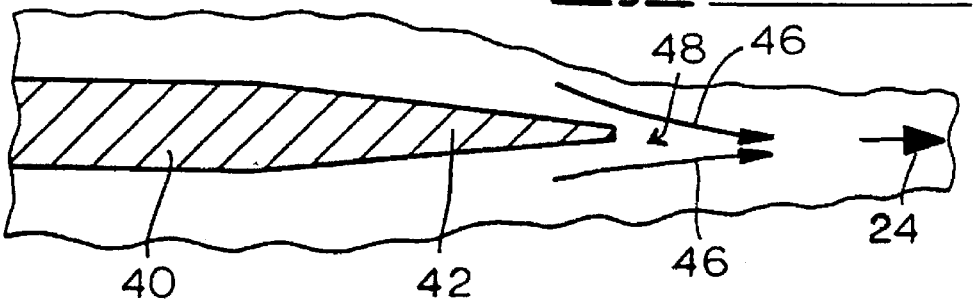
Fig.3 PRIOR ART
FIG. 3 is a partial cross-sectional view of a third embodiment of a headbox lamella known in the art.

FIGS. 1 to 3 show three different configurations of lamella ends known in the art. FIG. 1 shows a lamella 20 having a flat downstream end 22. An arrow 24 indicates the direction of pulp flow through the headbox and past the lamella 20. Arrows 26 indicate the flow of pulp past the end 22, illustrating a dead space, generally designated 28 in a wake of the lamella 20.

FIG. 2 shows a lamella 30 having an end portion 32 which is chamfered at one side 34 thereof. The arrows 36 indicate the flow of pulp past the end portion 32 and a dead space, generally designated 38 downstream of the lamella 30.

FIG. 3 shows a lamella 40 having an end portion 42 which is chamfered on both sides thereof. The arrows 46 indicate the flow of pulp past the end portion 42 and a dead space, generally designated 48 downstream of the lamella 40.

Figure 4:
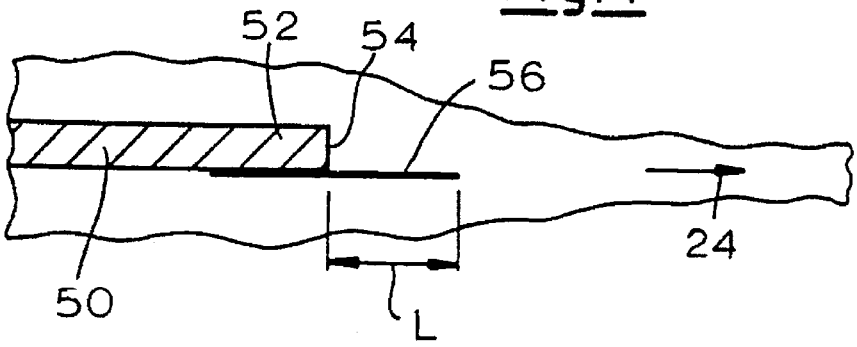
FIG. 4 is a partial cross-sectional view of a head box lamella according to the invention.

FIGS. 4–12 illustrate embodiments of lamella according to the invention. FIG. 4 shows a lamella 50 of standard design having a downstream end portion 52 with respect to the flow of pulp 24 with a flat end surface 54. A thin foil 56 is secured over the entire width of the lamella 50 and extends a length L from the end surface 54.

FIGS. 5A and 5B show an embodiment of a lamella 60 according to the invention having a downstream end portion 62 machined in a sawtooth manner.

FIGS. 6A and 6B show an embodiment of a lamella 70 according to the invention having a downstream end portion 72 machined in a step-wise manner. FIG. 6C shows a lamella 76 according to the invention having a cross-section similar to that of FIG. 6A with an end portion 78 machined in a step-wise manner with rounded inner regions 79.

FIG. 7 shows an embodiment of a lamella 82 according to the invention having a downstream end portion 84 which is narrowed in a step-wise manner at one side 86 thereof.

Figure 8:
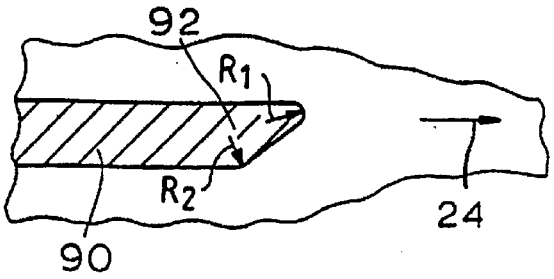
FIG. 8 is a partial cross-sectional view of a sixth embodiment of a headbox lamella according to the invention.

FIG. 8 shows an embodiment of a lamella 90 according to the invention having a downstream end portion 92 which designed asymmetrically, whereby the remaining edges are rounded with two different radii R1 and R2.

Figure 9A:
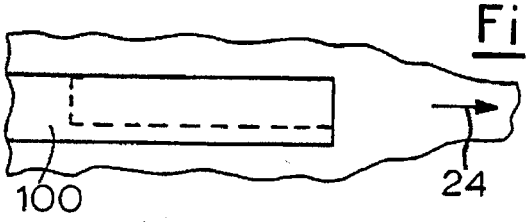
FIG. 9A is a partial side elevational view of a seventh embodiment of a headbox lamella according to the invention.
Figure 9B:
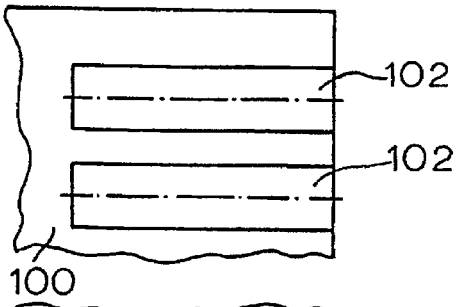
FIG. 9B is a partial top plan view of the lamella of FIG. 9A.
Figure 9C:
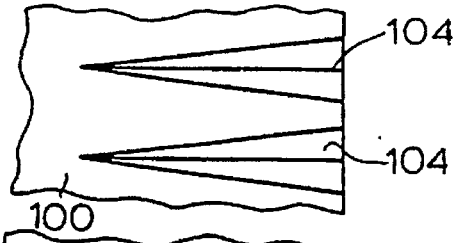
FIG. 9C is a partial top plan view of an eighth embodiment of a headbox lamella according to the invention having a grooves with a depth as shown in FIG. 9A.
Figure 9D:
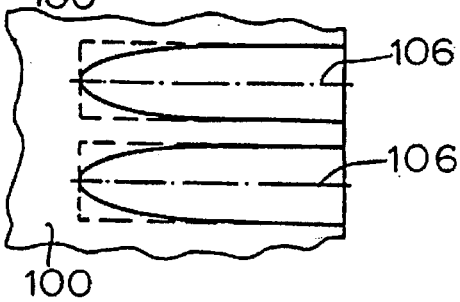
FIG. 9D is a partial top plan view of a ninth embodiment of a headbox lamella according to the invention having a grooves with a depth as shown in FIG. 9A.
Figure 9E:
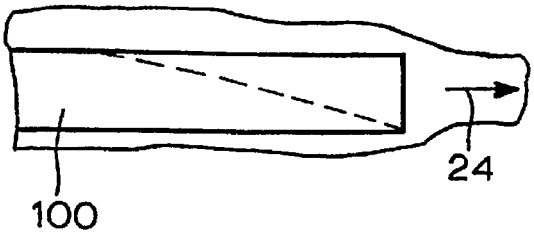
FIG. 9E is a partial side elevational view showing an alternative groove depth to that shown in FIG. 9A.

FIGS. 9A–9E show embodiments of lamellae 100 according to the invention in which grooves of various patterns are machined in the end region of the lamella. For example, FIGS. 9B, 9C, and 9D, show rectangular 102, V-shaped 104, and parabolic 106 grooves, respectively. According to the invention, the depth of the grooves shown in FIGS. 9B–9D can be constant as shown in FIG. 9A or increase (i.e., deepen) with respect to the direction of pulp flow 24 as shown in FIG. 9E.

FIGS. 10A and 10B each show front views of a lamella, 110 and 112, respectively, having grooves of the configuration shown in FIG. 9B. FIG. 10A shows grooves 116 on one side of the lamella 110 and grooves 118 on the other side thereof. The grooves 116 and 118 are in alignment (i.e. face one another). FIG. 10B shows grooves 120 on one side of the lamella 112 and grooves 122 on the other side thereof. The grooves 120 are displaced (i.e. offset) with respect to the grooves 122.

FIG. 11 shows an embodiment of a lamella 130 according to the invention having a downstream end portion 132 having grooves 134 oriented at an angle β to the direction 24 of the main flow of pulp through the headbox. In another embodiment of a lamella according to the invention (not shown), grooves are disposed on either side of the lamella with the center lines of the grooves on one side of the lamella disposed in a different direction than the center lines of grooves on the other side thereof.

Finally, FIG. 12 shows an embodiment of a lamella 140 according to the invention having a downstream end portion, generally designated 142 which includes a brush 144 which also prevents the development of the formation of periodic turbulence.

The embodiments of lamellae according to the invention shown herein can be used both for lamellae in one-layer headboxes having separate layers of the same pulp composition as well as for multi-layer headboxes having layers of different composition, but they are especially valuable for multi-layer headboxes in which at least two different streams of different consistency are to be combined with as little disturbance as possible.

Lamellae according to the invention may have grooves which are filled with a material having strong vibration-damping properties. Furthermore, lamellae according to the invention may be formed from fibrous composite materials so that the stiffness of a lamella in the direction of flow of pulp through the headbox is significantly higher than the lamella stiffness in the direction transverse to the direction of pulp flow. Preferred materials for lamellae according to the invention include carbon fiber plastic (CFP). Also preferred are lamellae having end portions made from polyurethane or an iron-nickel alloy containing 40–50% nickel marketed under the trademark "Invar."

The foregoing detailed description is given for clearness of understanding only, and no unnecessary limitations should be understood therefrom, as modifications within the scope of the invention will be apparent to those skilled in the art.

We claim:

1. A method of reducing turbulence in a pulp flow stream flowing through a paper making machine headbox, said headbox having lamellae disposed in a portion thereof, each lamella having a downstream end with a dead space being formed directly downstream of the downstream end with respect to the direction of pulp flow through the headbox, the method comprising the step of:

providing means for flushing the dead space by forming small flow channels in a surface of a lamella, said channels being located at a downstream end portion of the lamella and dividing the pulp stream flowing past the lamella into a plurality of substreams guided into the region of the dead space, wherein the surface defining the channels extends across a width of each channel, and wherein a depth of each channel at an end portion of each channel is one of increasing in the direction of flow of material through the headbox and substantially constant in the direction of flow of material through the headbox.

2. The method of claim 1 including the step of shifting the natural frequency of the lamellae, and any integer multiple thereof, away from the excitation frequency arising from the pulp flow.

3. The method of claim 1 including designing the damping properties of the lamellae to be large enough so that resonance phenomena are avoided.

4. The method of claim 1 including influencing the excitation frequency of the pulp flow in such a manner to produce a pulp flow excitation frequency outside of the resonance region of the lamellae.

5. A paper making machine headbox, said headbox comprising a lamella having a downstream end portion with respect to a direction of flow of material through the headbox, said end portion comprising a first tooth and a second tooth neighboring the first tooth, the first and second teeth disposed at a downstream end of the end portion and forming a curved wall defining a rounded inner region disposed between the first and second teeth, the rounded inner region having a width perpendicular to the direction of flow of material through the headbox and parallel to a horizontal plane through the lamella, the width of the rounded inner region increasing in the direction of flow of material through the headbox.

6. The headbox of claim 5 wherein the lamella is formed from fibrous composite materials so that the stiffness of the lamella in a direction of flow of material through the headbox is significantly higher than the stiffness thereof in the direction transverse to said flow direction.

7. The headbox of claim 5 wherein the lamella is formed from carbon fiber plastic and the end portion thereof is made from a material selected from the group consisting of polyurethane and an iron-nickel alloy.

8. A paper making machine headbox, said headbox comprising a lamella having a downstream end portion with respect to a direction of flow of material through the headbox, said end portion defining grooves formed in a surface of said end portion and located only in said end portion, wherein the grooves have a shape defined in a horizontal plane through the lamella, the shape being selected from the group consisting of a rectangle, a wedge having a broad side pointing in the direction of flow of material through the headbox, and a parabolic outline, wherein the surface defining the grooves extends across a width of the grooves, and wherein a depth of each groove at the end portion of each groove is one of substantially constant in the direction of flow of material through the headbox and increasing in the direction of flow of material through the headbox.

9. The headbox of claim 8 wherein, with respect to a cross-section transverse to a direction of flow of material through the headbox, the grooves have a rectangular shape.

10. The headbox of claim 8 wherein the depth of the grooves is constant.

11. The headbox of claim 8 wherein the depth of the grooves increases in a direction of flow of material through the headbox.

12. The headbox of claim 8 wherein grooves are provided on a top side and a bottom side of the lamella.

13. The headbox of claim 12 wherein the grooves on the top side and the bottom side are displaced with respect to one another.

14. The headbox of claim 12 wherein the grooves of the top side coincide with the grooves of the bottom side.

15. The headbox of claim 8 wherein center lines of the grooves are inclined with respect to a direction of flow of material through the headbox.

16. The headbox of claim 8 wherein the grooves are filled with a material having strong vibration-damping properties.

17. The headbox of claim 8 wherein the lamella is formed from fibrous composite materials so that the stiffness of the lamella in a direction of flow of material through the headbox is significantly higher than the stiffness thereof in the direction transverse to said flow direction.

18. A paper making machine headbox, said headbox comprising a lamella extending across the entire width of the headbox and having an end, said lamella end having a brush attached thereto along an entire width thereof, said brush having bristles pointing in the direction of flow of material through the headbox.

19. The headbox of claim 18 wherein the lamella is formed from fibrous composite materials so that the stiffness of the lamella in a direction of flow of material through the headbox is significantly higher than the stiffness thereof in the direction transverse to said flow direction.

20. A paper making machine headbox, said headbox comprising a lamella having an end portion, said end portion defining grooves formed in a surface of said end portion and located only in said end portion, wherein the grooves are oriented at an oblique angle with respect to a direction of flow of material through the headbox, wherein the grooves have a width perpendicular to the direction of flow of material through the headbox and parallel to a horizontal plane through the lamella, the width increasing in the direction of flow of material through the headbox, and wherein the surface defining the grooves extends across the width of the grooves.

21. A paper making machine headbox, said headbox comprising a lamella having a downstream end portion with respect to a direction of flow of material through the headbox, wherein a top side of the downstream end portion of the lamella is narrowed in a step-wise manner and a bottom side of the downstream end portion of the lamella is substantially flat.

22. The headbox of claim 21 wherein a downstream end of the lamella has a lamella thickness of less than 1 mm.

* * * * *